United States Patent [19]

Cha

[11] 4,162,706

[45] Jul. 31, 1979

[54] DETERMINING THE LOCUS OF A PROCESSING ZONE IN AN OIL SHALE RETORT BY MONITORING PRESSURE DROP ACROSS THE RETORT

[75] Inventor: Chang Y. Cha, Bakersfield, Calif.

[73] Assignee: Occidental Oil Shale, Inc., Grand Junction, Colo.

[21] Appl. No.: 868,924

[22] Filed: Jan. 12, 1978

[51] Int. Cl.[2] ..... E21B 43/24

[52] U.S. Cl. ..... 166/251; 166/259; 299/2; 166/303

[58] Field of Search ..... 166/251, 250, 252, 259, 166/256, 261, 302, 303; 299/2

[56] References Cited

U.S. PATENT DOCUMENTS

| | | | |
|---|---|---|---|
| 2,481,051 | 9/1949 | Uren | 299/2 |
| 3,031,762 | 5/1962 | Parker | 166/251 X |
| 3,072,184 | 1/1963 | Parker | 166/251 |
| 3,182,721 | 5/1965 | Hardy | 166/251 X |
| 3,586,377 | 6/1971 | Ellington | 166/259 X |
| 4,007,963 | 2/1977 | Ridley | 299/2 |

OTHER PUBLICATIONS

Burwell et al., "Permeability Changes and Compaction of Broken Oil Shale During Retorting", U.S. Bureau of Mines, Report of Investigations, 7860, 1974, 16 pp.

Needham, "Prediction of the Permeability of a Fragmented Oil Shale Bed during In-Situ Retorting with Hot Gas", Paper No. SPE 6071, presented Fall 1976, Society of Petroleum Engineers of AIME, 8 pp.

Thomas, "Some Effects of Overburden Pressure on Oil Shale During Underground Retorting", Society of Petroleum Engineers Journal, Mar. 1966, pp. 1–7.

Tisot, et al., "Structural Deformation of Green River Oil Shale as it Relates to In Situ Retorting", U.S. Dept. of Interior, BuMines Report of Investigations, 7576, 1971, 27 pp.

van Poollen, "Transient Tests Find Fire Front in an In-Situ Combustion Project", The Oil and Gas Journal, vol. 63, No. 5, Feb. 1, 1965, pp. 78–80.

*Primary Examiner*—Stephen J. Novosad

*Attorney, Agent, or Firm*—Christie, Parker & Hale

[57] ABSTRACT

A processing zone advances through a fragmented permeable mass of particles containing oil shale in an in situ oil shale retort in a subterranean formation containing oil shale. The retort has an inlet gas introduced thereto and an effluent gas withdrawn therefrom. To determine the locus of the processing zone, kerogen content of formation at selected locations in the retort is determined before processing the selected locations. Because the difference in pressure between the inlet gas and the effluent gas increases as the kerogen content of formation being processed increases, changes in pressure drop across the fragmented mass can be predicted. By comparing actual changes in pressure drop with predicted change in pressure drop, the locus of the processing zone can be determined.

31 Claims, 5 Drawing Figures

DETERMINING THE LOCUS OF A PROCESSING ZONE IN AN OIL SHALE RETORT BY MONITORING PRESSURE DROP ACROSS THE RETORT

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which, upon heating, decomposes to produce liquid and gaseous hydrocarbon products. It is the formation containing kerogen that is called "oil shale" herein, and the liquid hydrocarbon product is called "shale oil".

A number of methods have been proposed for processing the oil shale, which involve either first mining the kerogen-bearing shale and processing the shale above ground, or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation by fragmenting such formation to form a stationary, fragmented, permeable mass of formation particles containing oil shale within the formation, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of a gaseous combustion zone feed comprising oxygen into the combustion zone to advance the combustion zone through the retort. In the combustion zone, oxygen in the gaseous combustion zone feed is depleted by reaction with hot carbonaceous materials to produce heat and combustion gas. By the continued introduction of the combustion zone feed into the retort, the combustion zone is advanced through the retort.

The effluent gas from the combustion zone comprises combustion gas and any gaseous portion of the combustion zone feed that does not take part in the combustion process. This effluent gas is essentially free of free oxygen and contains constituents such as oxides of carbon. It passes through the fragmented mass in the retort on the advancing side of the combustion zone to heat the oil shale in a retorting zone to a temperature sufficient to produce kerogen decomposition, called retorting, in the oil shale to gaseous and liquid products and to a residue of solid carbonaceous material.

As used herein, the term "processing gas" is used to indicate gas which serves to advance a processing zone, such as a combustion zone, a retorting zone, or both a retorting zone and combustion zone, through the fragmented mass in an in situ oil shale retort and includes, but is not limited to, an oxygen supplying gas introduced into a retort for advancing a combustion zone and retorting zone through a retort, and a hot retorting gas which can be introduced into a retort or generated in a combustion zone in a retort for advancing a retorting zone through a retort.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift, or shaft. An effluent gas, referred to herein as off gas, containing combustion gas generated in the combustion zone, gaseous products produced in the retorting zone, carbon dioxide from carbonate decomposition, and any gaseous portion of the combustion zone feed that does not take part in the combustion process is also withdrawn from the retort.

There are several reasons that it is desirable to know the locus of parts of the combustion and retorting processing zones as they advance through an in situ oil shale retort. One reason is that by knowing the locus of the combustion zone, steps can be taken to control the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason that it can be desirable to monitor the locus of the combustion zone is to provide information so the composition of the combustion zone feed can be varied with variations in the kerogen content of oil shale being retorted. Formation containing oil shale includes horizontal strata or beds of varying kerogen content, including strata containing substantially no kerogen, and strata having a Fischer assay of 80 gallons of shale oil per ton of oil shale. If combustion zone feed containing too high a concentration of oxygen is introduced into a region of the retort containing oil shale having a high kerogen content, oxidation of carbonaceous material in the oil shale can generate so much heat that fusion of the oil shale can result, thereby producing a region of the fragmented mass which cannot be penetrated by retorting gases.

Another reason for monitoring the locus of the combustion and retorting processing zones as they advance through the retort is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

SUMMARY

The present invention concerns a process for determining the locus of a processing zone advancing through a fragmented permeable mass of particles in an in situ oil shale retort in a subterranean formation containing oil shale. The retort has an inlet gas introduced thereto and an effluent gas withdrawn therefrom. The method of the present invention comprises determining kerogen content in formation containing oil shale at selected locations in the retort before processing the selected locations. Because the pressure difference between the inlet gas to the retort and the effluent gas withdrawn from the retort changes with the kerogen content of the formation being processed, the difference between the pressure of the inlet gas and the pressure of the effluent gas can be predicted for processing formation particles at selected elevations in the fragmented mass. Therefore, the pressure difference between the inlet gas to the retort and the effluent gas from the retort is predicted, the actual pressure difference between the inlet gas to the retort and the effluent gas from the retort is determined, and such a determined pressure difference is compared with such a predicted pressure difference for determining the locus of a processing zone in the fragmented mass.

DRAWINGS

These and other features, aspects, and advantages of the present invention will become more apparent upon consideration of the following description, appended claims, and accompanying drawings wherein:

Figure 4:
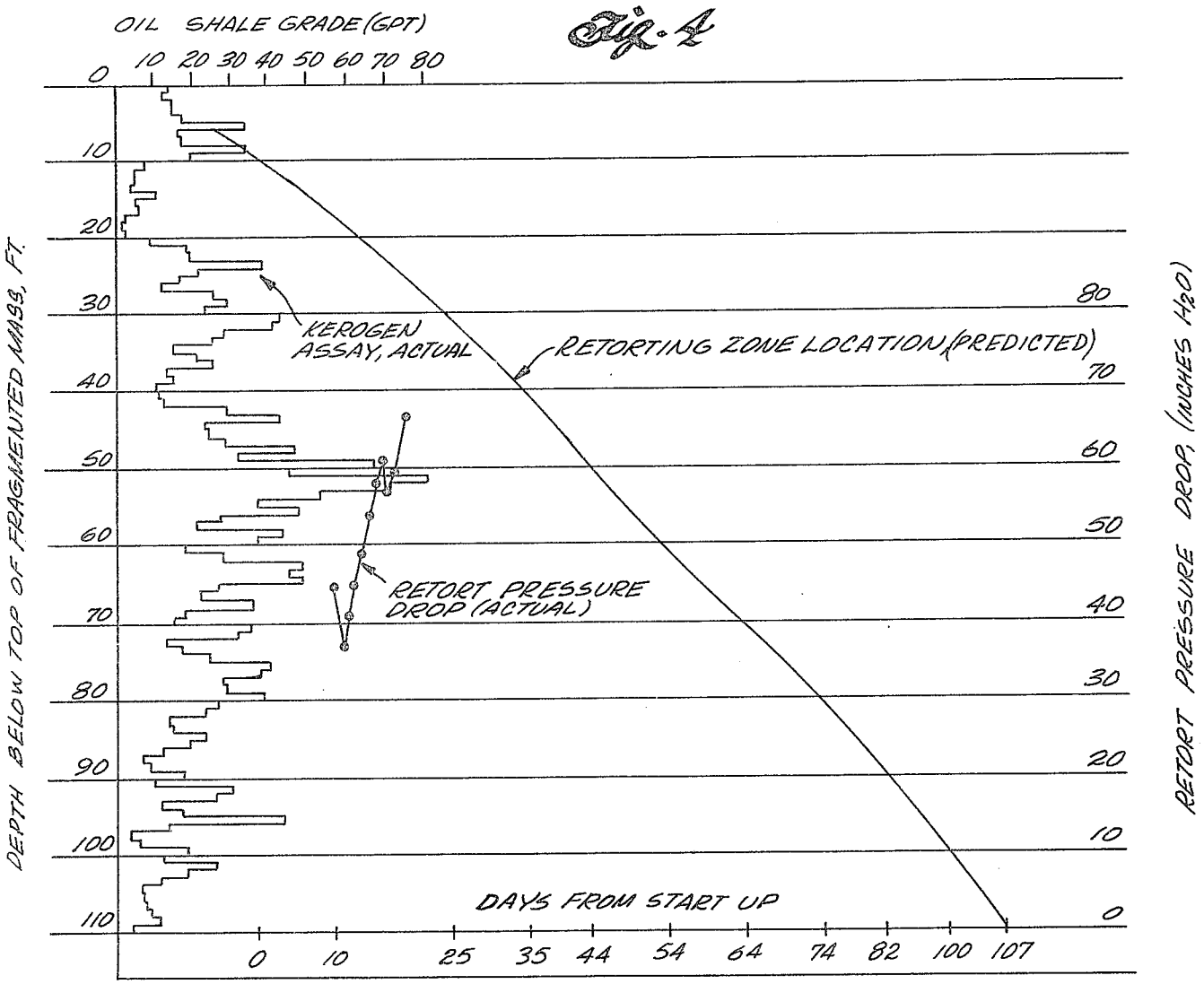
Figure 5:
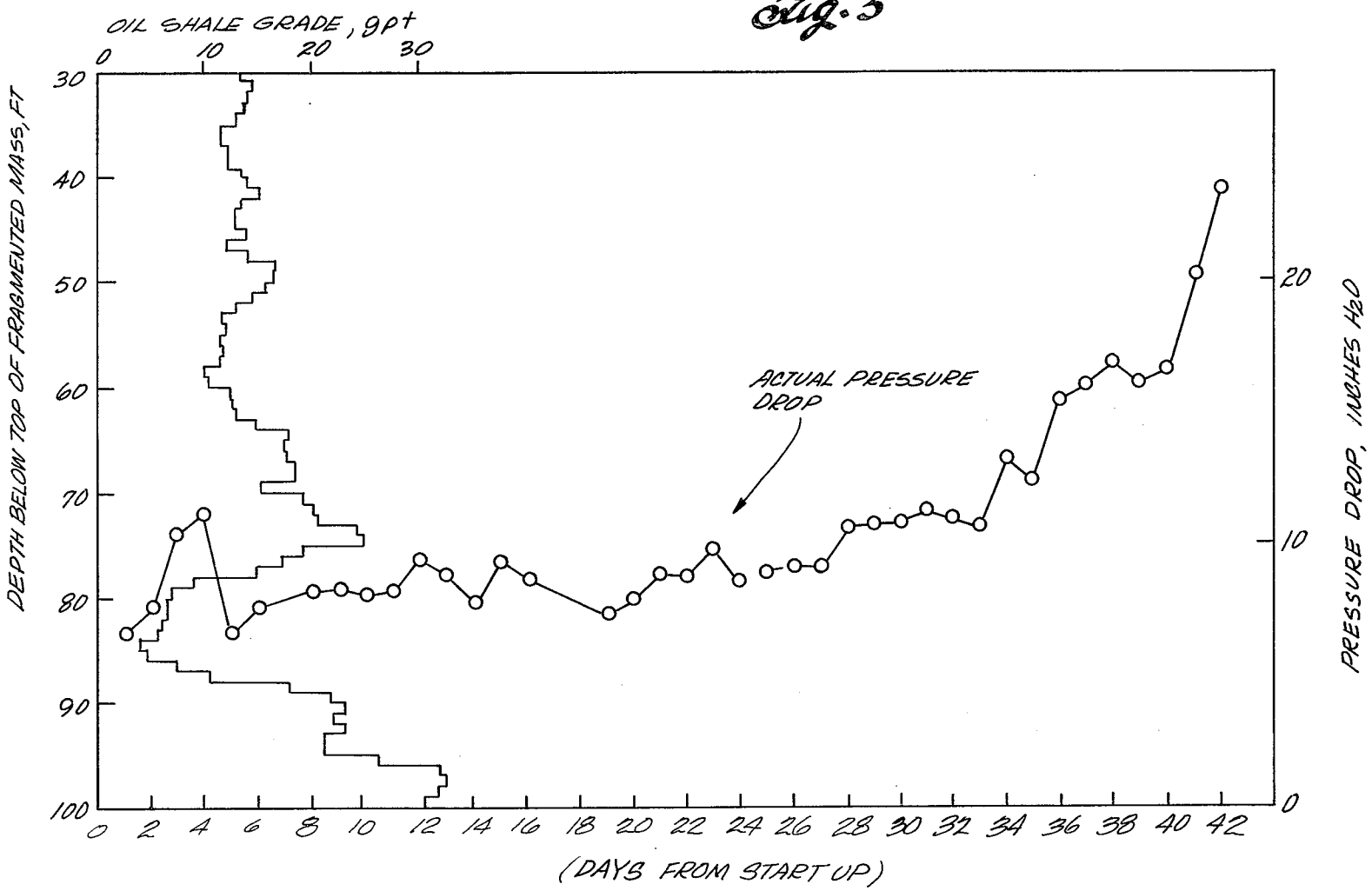

FIG. 4 shows for an in situ oil shale retort like the retort of FIG. 1: oil shale grade as a function of depth below the top of the fragmented mass in the retort; predicted location of the retorting zone during retorting; and actual pressure drop across the fragmented mass; and FIG. 5 shows for an in situ oil shale retort like the retort of FIG. 1: oil shale grade as a function of depth below the top of the fragmented mass in the retort; and actual pressure drop across the fragmented mass.

DESCRIPTION

Figure 1:
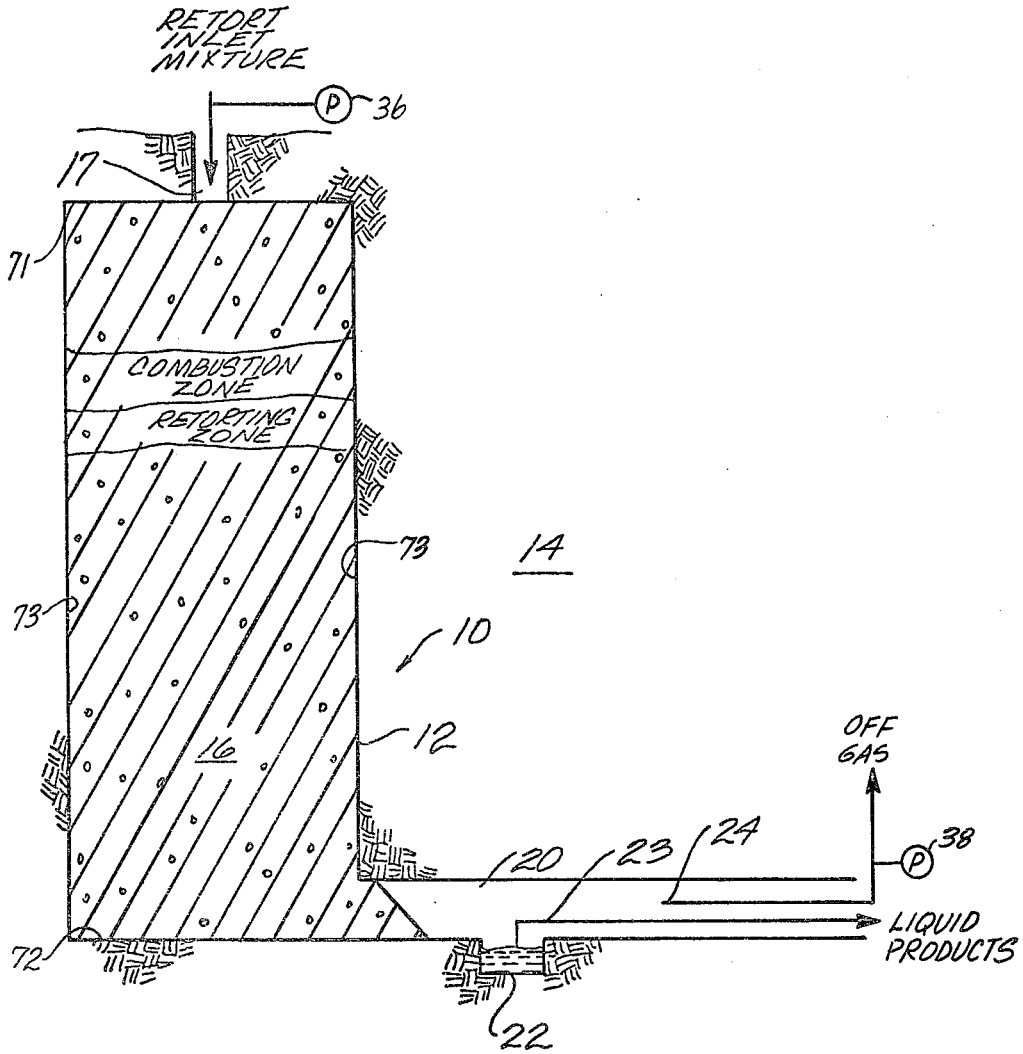
FIG. 1 represents schematically in vertical cross-section an in situ oil shale retort having means for measuring pressure of inlet gas and off gas.

Referring to FIG. 1, an in situ oil shale retort 10 is in the form of a cavity 12 formed in a subterranean formation 14 containing oil shale and having top 71, bottom 72, and side 73 boundaries of unfragmented formation. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void. Methods of forming an in situ oil shale retort are described in the aforementioned U.S. Pat. Nos. 3,661,423; 4,043,595; 4,043,596; 4,043,597; and 4,043,598. A variety of other techniques can also be used.

The fragmented permeable mass in the retort can have a void fraction of from about 10 to about 25%. By void fraction there is meant the ratio of the volume of voids or spaces between particles in the fragmented mass to the total volume of the fragmented permeable mass of particles in the retort. Thus, for example, for a void formation of 15%, a volume defined by the boundaries of the retort site would be 85% occupied by fragmented formation particles containing oil shale, and 15% of the volume would be occupied by void spaces between the fragmented particles.

A conduit 17 communicates with the top of the fragmented mass of formation particles. During the retorting operation of the retort 10, a combustion processing zone is established in the retort by ignition of carbonaceous material in oil shale. The combustion zone is advanced through the fragmented mass by introducing an oxygen containing retort inlet mixture into the in situ oil shale retort through the conduit 17 as a combustion zone feed. The retort inlet mixture can be air; or air enriched with oxygen; or air diluted by a fluid such as water, steam, a fuel, recycled off gas, an inert gas such as nitrogen; and combinations thereof. Oxygen introduced to the retort in the retort inlet mixture oxidizes carbonaceous material in the oil shale to produce combustion gas. The combustion processing zone is the portion of the retort where the greater part of the oxygen in the combustion zone feed that reacts with residual carbonaceous material in retorted oil shale is consumed. Heat from the exothermic oxidation reactions, carried by flowing gases, advances the combustion zone through the fragmented mass of particles.

Combustion gas produced in the combustion zone, and any unreacted portion of the combustion zone feed, pass through the fragmented mass of particles on the advancing side of the combustion zone to establish a retorting processing zone on the advancing side of the combustion zone. Kerogen in the oil shale is retorted in the retorting zone to produce liquid and gaseous products.

There is an access tunnel, adit, drift 20, or the like, in communication with the bottom of the retort. The drift contains a sump 22 in which liquid products are collected to be withdrawn for further processing. An off gas 24, containing gaseous products, combustion gas, gas from carbonate decomposition, and any gaseous unreacted portion of the combustion zone feed, is also withdrawn from the in situ oil shale retort 10 by way of the drift 20.

The retort inlet mixture can be introduced to the retort under pressure from gas transfer means, such as a blower (not shown). Alternatively, gas withdrawing means, such as a blower (not shown), can be used to withdraw off gas 24 from the retort and thereby create pressure less than ambient pressure throughout the retort to cause air, or other gaseous source of oxygen, to enter the retort through conduit 17. Also, gas pumping means for introducing the oxygen containing gas, and gas withdrawing means for withdrawing the off gas, can be used in combination.

The pressure differential from the top to bottom for vertical movement of gas down through the retort depends upon various parameters of the retort and retorting process, such as lithostatic pressure, void fraction of the fragmented mass, particle size in the fragmented mass, the temperature pattern of the retorting and combustion zones, gas volumetric flow rates, grade of oil shale being retorted, rate of heating of the fragmented mass, gas composition, gas generation from mineral decomposition, and the like. For example, an in situ retort having a height of 100 feet and containing a fragmented mass with about 20% void fraction can have a pressure differential less than about 1 psi from top to bottom for vertical movement of gas down through the retort at about 1 SCFM (standard cubic foot per minute) per square foot of horizontal cross-section of the fragmented mass. Retorts having greater heights have proportionately larger pressure drops. Thus, an adequate gas flow rate through retorts up to 1000 feet in height can be provided with a pressure differential of less than about 10 psi from top to bottom.

As used herein the term "pressure gradient" refers to the change of pressure experienced by gas passing through the fragmented mass per foot of thickness of the fragmented permeable mass. The terms "pressure differential" and "pressure drop" refer to the difference between the pressure of the retort inlet mixture and the pressure of the off gas. To determine such pressure differential, monitoring means 36 can be provided for determining the pressure of the retort inlet mixture, as shown in FIG. 1. The inlet pressure of the inlet mixture is substantially the same as the pressure at the top of the fragmented mass. Also, monitoring means 38 can be provided in the drift 20 for determining the withdrawal pressure of the off gas. The withdrawal pressure of the off gas is substantially the same as the pressure at the bottom of the fragmented mass. Instead of providing separate monitoring means 36 and 38 for determining the pressure differential across the fragmented mass, a single device, such as a manometer, can be connected to both the retort inlet mixture and off gas to determine pressure differential.

According to the present invention, the locus of the retorting and/or combustion processing zones can be determined by monitoring the pressure drop across the fragmented mass. This is because the pressure drop across the fragmented mass in an in situ oil shale retort can be correlated with the kerogen content of the formation being processed. A basis for this correlation can be described as follows.

The pressure drop in an in situ oil shale retort is proportional to $$\frac{\alpha}{d_v^2} \cdot \frac{(1-\epsilon)^2}{\epsilon^3} u + \frac{\beta}{d_v} \cdot \frac{1-\epsilon}{\epsilon^3} u^2 \quad (1)$$

where $\alpha$ and $\beta$ are constants of proportionality; $\epsilon$ is the void fraction, dimensionless; u is the velocity of gas through the fragmented mass, feet/second; and $d_v$ indicates a mean particle size, feet. The particle size $d_v$ is the ratio of particle volume-to-surface area and may include a shape factor. The absolute values of the various quantities are of minor significance for purposes of exposition, and it is only the proportionality that is of interest. The void fraction $\epsilon = \epsilon_o - (1-\epsilon_o)\gamma$ where $\gamma$ is the coefficient of thermal expansion, dimensionless, and $\epsilon_o$ is the void fraction without any thermal expansion of the particles containing oil shale.

This equation is in agreement with papers relating permeability of a fragmented permeable mass of formation particles containing oil shale, and thus pressure drop across the fragmented mass, to various retort and retorting process parameters. These papers include "Prediction of the Permeability of a Fragmented Oil Shale Bed During In Situ Retorting with Hot Gas", by R. B. Needham, Paper No. SPE 6071, presented at 1976 Fall Technical Conference and Exhibition of the Society of Petroleum Engineers of AIME; "Some Effects of Overburden Pressure on Oil Shale During Underground Retorting", by G. W. Thomas, Paper presented at Society of Petroleum Engineers 1965 Annual Fall Meeting; "Structural Deformation of Green River Oil Shale as It Relates to In Situ Retorting", by P. R. Tisot and H. W. Sohns, (Washington) U.S. Department of Interior, Bureau of Mines (1971); and "Permeability Changes and Compaction of Broken Oil Shale During Retorting", by Edward L. Burwell, Samuel S. Tihen and Harold W. Sohns, (Washington) U.S. Bureau of Mines (1974). Each of these papers is incorporated herein by this reference, and a copy of each of these papers accompanies this application. These papers indicate that the permeability of a fragmented permeable mass of oil shale particles tends to decrease, and thus pressure drop across the fragmented mass tends to increase, as overburden pressure increases, as grade of oil shale being retorted increases, as the temperature of the fragmented mass increases up to 800° F., and as the average particle size of the fragmented mass decreases.

Figure 2:
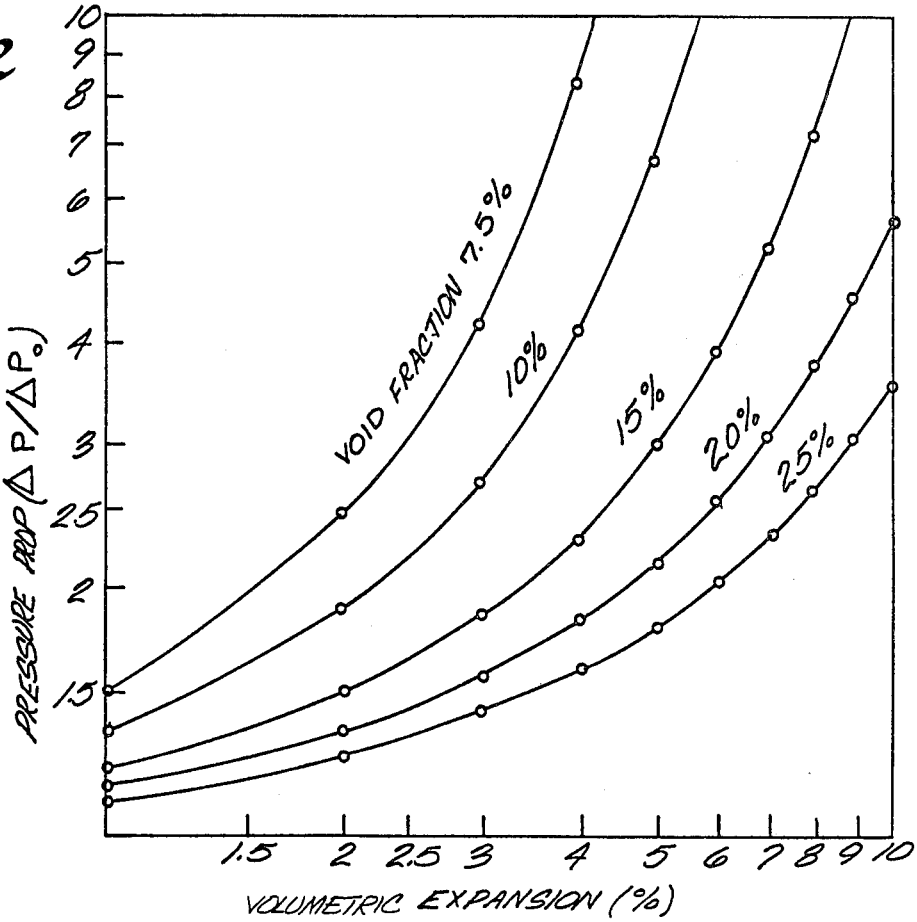
FIG. 2 is a graph indicating increase in pressure drop in an in situ oil shale retort as a function of the percentage expansion of fragmented formation particles containing oil shale for several void fractions.

The effect of thermal expansion on pressure drop across a fragmented mass is shown by FIG. 2, which is derived from the above equation. FIG. 2 is a graph illustrating the pressure drop in a fragmented permeable mass of formation particles containing oil shale in an in situ oil shale retort having a variety of void fractions as a function of the expansion of such fragmented formation particles. The graph illustrates the resistance to gas flow during retorting operations in a fragmented mass having such a variety of void fractions. The graph is a log-log plot with expansion in units of percent of volumetric expansion on the abscissa. The ordinate provides an indication of the pressure drop in terms of the ratio $\Delta P/\Delta P_o$, of a particular pressure drop, $\Delta P$, over the pressure drop without any expansion, $\Delta P_o$. Thus, the ratio would have a value of one if no expansion occurred in the fragmented mass. The illustrated graph covers the range of the ratio for expansions between one and ten percent. A family of curves are plotted in FIG. 2 for fragmented mass in which the void fraction is 7.5%, 10%, 15%, 20%, and 25% of the total volume in the fragmented mass. This graph shows that thermal expansion of the fragmented mass during retorting can greatly increase the pressure drop across the fragmented mass.

During the retorting operation, the pressure drop across the fragmented mass tends to increase with time as the retorting and combustion processing zones advance through the fragmented mass. This phenomenon is the result of the fragmented permeable mass of particles 16 undergoing thermal stresses due to temperature changes during the retorting operation. Initially, the particles in the fragmented mass are at ambient temperature. The particles are gradually heated to the temperature of the retorting zone, which can be as high as about 1100° F., and eventually the particles attain the temperature of the combustion zone, which can be up to the fusion temperature of oil shale, which is about 2100° F. Preferably, the temperature of the combustion zone is appreciably lower than the fusion temperature of oil shale. A zone of hot combusted oil shale can remain on the trailing side of the combustion zone. The thickness of the zone of hot combusted oil shale increases as the combustion zone advances downwardly through the fragmented mass.

This heating of the particles as the retorting and combustion zones approach causes swelling of the particles. Part of this swelling is temporary and results from thermal expansion, and part is permanent and is believed to be brought about by the retorting of kerogen in the shale. As the particles subsequently cool after the combustion zone has passed, the particles decrease in size from thermal contraction. The thermal swelling of particles in the retorting and combustion zones can diminish the size of spaces between particles, thereby decreasing the effective void fraction and the permeability of the fragmented mass. Because a portion of the swelling is permanent, and because a zone of hot particles remains on the trailing side of the combustion zone, a smaller cross-sectional area is available for gas flow through the fragmented mass. As shown by the graph of FIG. 2, such expansion is manifested by increased pressure drop across the fragmented mass.

Another phenomenon which can affect the pressure drop across the fragmented mass in a retort is a decrease in average particle size in the fragmented mass due to thermally induced disintegration of particles. As noted above, pressure drop across the fragmented mass tends to increase with a decrease in average particle size.

Also contributing to changes in pressure drop in the retort during retorting of oil shale can be a decrease in the effective void fraction of the fragmented mass due to absorption of liquid hydrocarbons on the surface of oil shale in the retorting zone and on the advancing side of the retorting zone. This tends to increase the pressure gradient in the retort in the retorting zone and on the advancing side of the retorting zone.

Superimposed on this tendency of the pressure drop across the fragmented mass to increase with time as the retorting and combustion processing zones advance through the fragmented mass are fluctuations and changes in the pressure drop across the fragmented mass with variations in processing parameters. For example, an increase in the rate at which the retort inlet mixture is introduced to the fragmented mass increases the pressure drop across the fragmented mass. As noted above, the pressure drop across the fragmented mass increases as the grade of oil shale being processed increases and decreases as the grade of oil shale being processed decreases. Although exact figures are not readily available and different formations containing oil shale have somewhat different properties, this is partly due to the phenomenon that the coefficient of expansion is a function of the kerogen content of the formation. There is a significantly larger coefficient of expansion in rich formation having a relatively higher kerogen content than in relatively lean formation having a relatively lower kerogen content. Formation having a rich kerogen content thus has a larger influence on pressure drop than does formation having a lean kerogen content. Formation particles containing the richer kerogen content expand more upon heating, thereby reducing the void fraction. This has been shown in an actual in situ oil shale retort.

It is believed that the large expansion of formation particles having a relatively high kerogen content can be in part due to thermal decomposition and resultant phase changes in the kerogen locked in the formation. Fragmented formation particles containing oil shale are relatively impervious, and thermal decomposition of the kerogen produces liquid and gaseous hydrocarbons at a rapid rate. Appreciable portions of the liquid hydrocarbons can be vaporized as retorting temperatures approach 900° F. These products inherently occupy a higher volume than the kerogen from which they are formed. Because of limited diffusion rates some of these products can be temporarily isolated in the formation particles in which the kerogen is dispersed, and their increased volume places a stress on the formation particles that results in expansion appreciably larger than present in formation particles without such retorting products.

Figure 3:
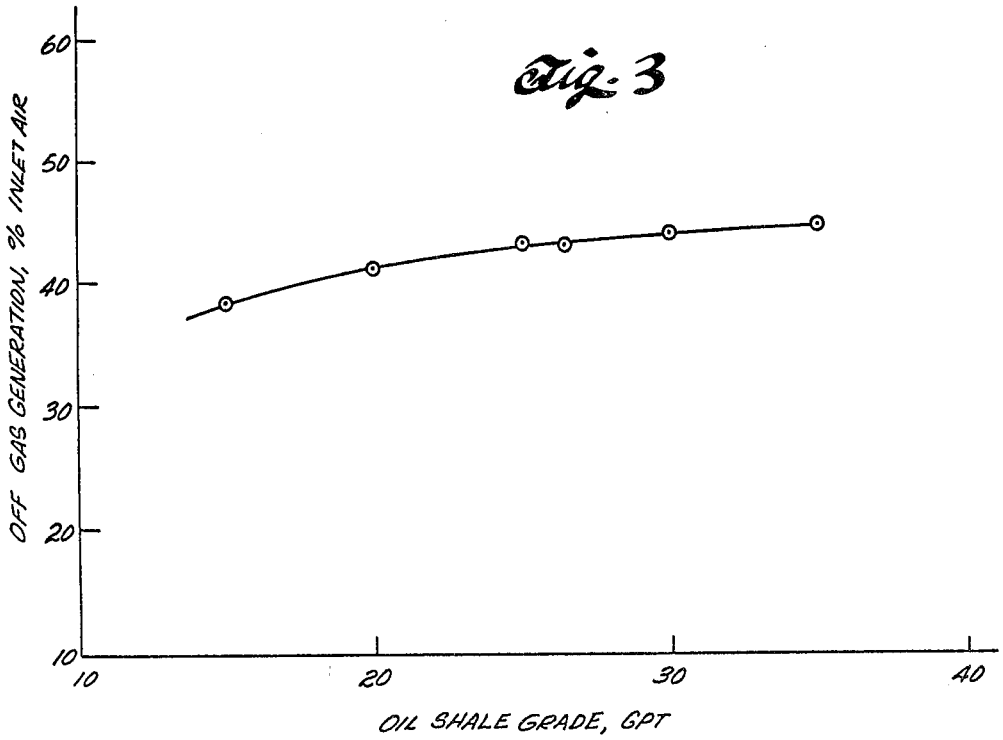
FIG. 3 shows off gas generation rate as a function of oil shale grade for an in situ oil shale retort like that of FIG. 1.

Other factors in addition to the permeability of a fragmented permeable mass of particles containing oil shale tending to decrease, result in the pressure drop across the fragmented mass increasing as grade of oil shale being retorted increases. For example, fragmented formation particles containing higher grade oil shale tend to have a higher temperature during retorting than lower grade shale. Thus, because the volume and viscosity of gases increase as the gas temperature increases, the pressure gradient is increased across the relatively hotter zone of higher grade shale. Furthermore, more volatilized hydrocarbons are released by decomposition of kerogen in the oil shale, and more carbon dioxide is released due to decomposition of alkaline earth metal carbonates present in oil shale as the temperatures of the retorting and combustion zones increase. For example, FIG. 3 shows projected off gas production rate as a function of shale grade for an in situ oil shale retort like that of FIG. 1. As shown in FIG. 3, off gas production rate increases as the grade of oil shale being retorted increases. This tends to result in the pressure gradient across the retorting and combustion zones increasing as the grade of oil shale being retorted increases.

To take advantage of this correlation between pressure drop and grade of oil shale being processed, formation at selected elevations is assayed for kerogen content to develop a correlation of kerogen content versus elevation in the fragmented mass. In the Western United States, oil shale often is horizontally bedded due to the sedimentary nature of oil shale. Layers in the fragmented mass are correlated with strata in the unfragmented a formation because there is little vertical mixing between strata when explosively fragmenting particles. Therefore, samples of various strata through the retort can be taken before initiating retorting of the oil shale, and assays can be conducted to determine content of kerogen in layers in the retort at selected elevations. Such samples can be taken from within the fragmented mass, from formation in the retort site before expansion, or from formation nearby the fragmented mass since little change in kerogen content of oil shale occurs over large areas of formation.

From the samples and the correlation between pressure drop across the fragmented mass and the kerogen content of the formation, the pressure drop and changes in the pressure drop across the fragmented mass can be predicted as a function of the elevation of the processing zone in the fragmented mass.

As used herein, the term "content" is used to refer to the total amount or the concentration of kerogen in the formation.

The pressure drop can be predicted to give an approximate value of the pressure drop across the fragmented mass as a function of the elevation of the processing zone in the fragmented mass. Production also can be based upon emperical results developed by observation of pressure drop across the fragmented mass in other in situ oil shale retorts. Also, the prediction can be in terms of changes in pressure drop as retorting progresses. For example, it can be predicted with reasonable certainty that pressure drop will change to reach its maximum when retorting a fragmented mass when the richest oil shale in the fragmented mass is being retorted.

To determine the elevation of a processing zone in an in situ oil shale retort, formation is assayed at selected elevations for kerogen content; using a correlation between the pressure drop across the fragmented mass and the kerogen content of the oil shale being processed, the pressure drop across the fragmented mass is predicted for processing at least one elevation in the fragmented mass; the actual pressure drop across the fragmented mass is determined; and predicted pressure drop and actual pressure drop are compared. Thus, by knowing the kerogen content in the fragmented mass 16 at selected elevations, by knowing the correlation between kerogen content and pressure drop across the fragmented mass, and by knowing the actual pressure drop across the fragmented mass, the elevation of a processing zone in the retort can be determined.

As noted above, the pressure drop across the fragmented mass depends on other retort and retorting process parameters, such as rate of introduction of the retort inlet mixture, overburden pressure, average void fraction of the fragmented mass, and average size of particles in the fragmented mass. When comparing predicted and actual changes in pressure drop, variations in these parameters should be considered. For example, according to equation (1), pressure drop, $\Delta P$, across the fragmented mass in proportional to velocity, u. Therefore, when comparing predicted and actual pressure drop, actual $(\Delta P/u^x)$ can be compared against predicted $(\Delta P/u^x)$, where x is an experimentally-determined value from about 1 to about 3. Using this approach, variations in rate of introduction of the retort inlet mixture do not affect the validity of the comparison of predicted and actual pressure drop.

A value for x can be determined for a retort by varying the rate of gas flow through the retort, while holding other retorting parameters constant; measure $\Delta P$; and prepare a log-log plot of $\Delta P$ versus U. The slope of the plot is equal to x.

Therefore, when reference is made herein to comparing actual and predicted pressure drop, or comparing the first derivative of actual and predicted pressure drop, there is also meant comparison of pressure drops normalized for retort and retorting process parameters.

Not only can the method of this invention be used for determining the elevation of a processing zone in a fragmented permeable mass in a retort and for detecting deviations from a desired or predicted elevation, it can also be used to determine the orientation of the processing zone. If a processing zone is substantially flat and horizontal, it encounters layers of different content of kerogen relatively abruptly. Thus, changes in pressure drop across the fragmented mass can clearly be associated with changes in kerogen content. If the retorting zone is skewed or significantly warped, it can encounter several layers of different kerogen content at substantially the same time, thereby tending to obscure the correlation between pressure drop and the location of the retorting zone in the fragmented mass. Pressure drop needs to be determined at least twice to determine the first derivative of pressure drop as a function of time. In essence, the first derivative of the pressure drop as a function of time is reduced when the retorting zone is skewed or non-planar as compared with the first derivative of the pressure drop when the retorting zone is substantially flat and horizontal. Thus, it is possible to determine if a retorting or combustion zone is substantially planar and substantially normal to its direction of advancement by comparing the first derivative of determined pressure drop with the first derivative of predicted pressure drop.

With substantially flat and horizontal processing zones, the first derivative of pressure drop versus time is proportional to the difference in kerogen content between the layer of particles from which the processing zone is advancing and the layer of particles into which the processing zone is advancing. A positive value of the first derivative indicates that the processing zone is advancing from a layer of relatively lower kerogen content to a layer of relatively higher kerogen content. Similarly, a negative value of the first derivative indicates that the processing zone is advancing from a layer of relatively higher kerogen content to a layer of relatively lower kerogen content. Therefore, by determining the first derivative of pressure drop versus time and comparing such determined first derivatives, it is possible to determine when a processing zone is at a location in the fragmented mass at which there is a change in kerogen content. From the histogram of oil shale content versus elevation in the retort, the elevation of the processing zone can thus be determined.

In summary, by monitoring the pressure drop across the fragmented mass, one can determine not only the location of a processing zone in the retort, but also deviations of the processing zone from its desired shape or orientation.

The following examples demonstrate methods embodying features of this invention:

EXAMPLE 1

A retort was formed in the south-southwest portion of the Piceance Creek Basin of Colorado. The retort contained a fragmented permeable mass of formation particles which was formed by explosively expanding formation toward a vertically extending void. The fragmented mass had an average void fraction of about 17%. The fragmented mass was square with side dimensions of about 118 feet and was about 165–200 feet high with a sloping bottom boundary. The oil shale in the fragmented mass was in horizontal strata, i.e., the fragmented mass comprised horizontal layers, the oil shale within each layer having about the same kerogen content.

Prior to forming the fragmented permeable mass, core samples of formation were taken and analyzed for kerogen content by Fischer assay. The results of this analysis are presented on the left of FIG. 4, which shows a histogram of oil shale grade versus depth below the top of the fragmented mass in the retort.

Off gas production rate as a function of oil shale grade was projected for this retort, and the results are presented in FIG. 3.

It was projected that the retorting zone would advance through the fragmented permeable mass at an average rate of a little greater than 1 foot per day. Using this rate of advancement, the retorting zone location as a function of days from start-up estimated and plotted in FIG. 4. These projections were based on the assumption that the retort inlet mixture consisted of 70% air and 30% steam, and was introduced to the retort by a rate of 0.62 SCFM (standard cubic foot per minute) per square foot cross-sectional area on the fragmented mass.

A combustion zone was established in the fragmented mass using shale oil as a fuel. Once the combustion zone was established, introduction of fuel was stopped. The combustion zone was advanced downwardly through the fragmented mass using a retort inlet mixture consisting of about 70% air and 30% steam at a volumetric flow rate of about 0.62 SCFM per square foot of cross-sectional area of the fragmented permeable mass. The actual pressure drop across the fragmented mass was monitored, and is plotted in FIG. 4.

As shown in FIG. 4, the measured pressure drop across the fragmented mass increased significantly from about day 10 to about day 15. It is believed that this was caused by gas flow channeling in the retort, where the combustion and retorting zones advanced in one region of the retort rather rapidly, while advancing more slowly in other regions. Thus, the retorting zone was in the shape of a "spike" or "wedge" extending in part into a region of rich oil shale in the fragmented mass about 50 feet below the top of the fragmented mass. In other words, the retorting zone was not planar, and a portion of it had advanced on about the 15th day from start-up to an elevation in the fragmented mass to which it should not have advanced until about the 45th day from start-up.

This conclusion was reinforced by the temperature of the off gas, which was higher than predicted. Therefore, corrective measures were taken to establish a substantially flat retorting zone.

EXAMPLE 2

Another retort was formed in the south-southwest portion of the Piceance Creek Basin of Colorado. The retort contained a fragmented permeable mass of formation particles which were formed by explosively expanding formation toward vertically extending voids. The fragmented mass was square with side dimensions of about 120 feet and was about 270 feet high. The oil shale in the fragmented mass was in horizontal strata, i.e., the fragmented mass comprised horizontal layers, the oil shale in each layer having about the same kerogen content.

Prior to forming the fragmented permeable mass, core samples of formation were taken and analyzed for kerogen content by Fischer assay. The results of this analysis are presented on the left of FIG. 5, which shows a histogram of oil shale grade versus depth below the top of the fragmented mass in the retort. The zone of richest oil shale began at about 73 feet below the top of the fragmented mass.

A combustion zone was established in the fragmented mass using liquefied petroleum gas as a fuel. Once the combustion zone was established, introduction of fuel was stopped. The combustion zone was advanced downwardly through the fragmented mass using a retort inlet mixture consisting of air, and as a diluent, recycle gas and/or steam. The actual pressure drop across the fragmented mass was monitored, and is plotted in FIG. 5.

As shown in FIG. 5, the pressure drop across the fragmented mass tended to gradually increase as retorting progressed. On days 33 and 40, the pressure drop noticeably increased. This indicates that the retorting zone consisted of two distinct sections both of which were reasonably uniform, where the first and second sections of the retorting zone arrived at 73 feet from the top of the fragmented mass on days 33 and 40, respectively.

This conclusion was reinforced by calculations based on mathematical modeling of operation of this retort, and variations in concentration of methane in the product gas, which is proportional to the average grade of oil shale being processed.

Monitoring the locus of a processing zone, such as a combustion zone or retorting zone advancing through the fragmented permeable mass 16 in the retort 10, has significant advantages. For example, steps can be taken to maintain the combustion zone flat and uniformly perpendicular to the direction of its advancement to minimize oxidation and excessive cracking of hydrocarbons produced in the retorting zone. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of and introduction rate of the retort inlet mixture.

Although this invention has been described in considerable detail with reference to certain versions thereof, other versions of this invention can be practiced. For example, although the invention has been described in terms of an in situ shale retort containing both a combustion processing zone and a retorting processing zone, it is possible to practice this invention with a retort containing only one processing zone, either a combustion or retorting zone. In addition, although FIG. 1 shows a retort where the combustion and retorting zones are advancing downwardly through the retort, this invention is also useful for retorts where the combustion and retorting zones are advancing upwardly or transverse to the vertical.

Because of variations such as these, the spirit and scope of the appended claims should not necessarily be limited to the description of the preferred version contained herein.

What is claimed is:

1. In a method for recovering gaseous and liquid products from an in situ oil shale retort in a subterranean formation containing oil shale, the subterranean formation including a plurality of generally horizontal strata containing oil shale having different contents of kerogen, the in situ retort containing a fragmented permeable mass of formation particles containing oil shale and having a combustion processing zone and a retorting zone advancing therethrough, wherein the method comprises the steps of:

forming an in situ oil shale retort containing a fragmented permeable mass of formation particles containing oil shale in the formation, the fragmented mass containing generally horizontal layers of particles correlated with such strata;

introducing to the in situ oil shale retort on the trailing side of the combustion processing zone a combustion zone feed comprising oxygen for advancing the combustion processing zone through the fragmented mass of particles and for producing combustion gas in the combustion processing zone;

passing said combustion gas and any gaseous unreacted portion of the combustion zone feed through a retorting processing zone in the fragmented mass of particles on the advancing side of the combustion processing zone, wherein oil shale is retorted and gaseous and liquid products are produced;

withdrawing liquid products and a retort off gas comprising said gaseous products, combustion gas and any gaseous unreacted portion of the combustion zone feed from the in situ oil shale retort from the advancing side of the retorting processing zone;

the improvement comprising determining the locus of a processing zone in the fragmented mass by the steps of:

predicting the difference between the pressure of the combustion zone feed and the pressure of the retort off gas due to processing of formation particles at selected elevations in the fragmented mass;

monitoring pressure of combustion zone feed introduced to the retort;

monitoring pressure of retort off gas from the retort;

determining the difference between such a monitored pressure of the combustion zone feed and a substantially simultaneously monitored pressure of the retort off gas; and comparing such a determined difference in pressure with such a predicted difference in pressure for determining the locus of such a processing zone in the fragmented mass.

2. The method of claim 1 wherein the comparing step comprises comparing the first derivative of such a determined difference in pressure versus time with the first derivative of such a predicted difference in pressure versus time.

3. A method for determining the locus of a processing zone advancing through a fragmented permeable mass of particles containing oil shale in an in situ oil shale retort in a subterranean formation containing oil shale, the retort having an inlet gas introduced thereto and an effluent gas passing therefrom, the method comprising the steps of:

determining kerogen content in formation containing oil shale at selected locations in the retort before processing the selected locations;

determining, at least twice, the pressure difference between the inlet gas to the retort and the effluent gas from the retort during processing; and determining the first derivative of such determined pressure difference versus time.

4. The method of claim 3 wherein the processing zone is a retorting zone.

5. The method of claim 3 wherein the processing zone is a combustion zone.

6. The method of claim 3 including the steps of predicting a first pressure difference versus time and comparing such a determined first derivative with such a predicted first derivative.

7. The method of claim 3 wherein at least two first derivatives of determined pressure difference versus time are determined and including the step of comparing such a determined first derivative with another determined first derivative.

8. A method for determining the locus of a processing zone advancing downwardly through a fragmented permeable mass of particles containing oil shale in an in situ oil shale retort in a subterranean formation containing oil shale, said subterranean formation including a plurality of generally horizontal strata having different kerogen content, the method comprising the steps of:

forming an in situ oil shale retort containing a fragmented permeable mass of formation particles containing oil shale in the formation, the fragmented mass containing generally horizontal layers of particles correlated with such strata;

assaying kerogen content in layers in the fragmented mass at selected elevations;

predicting pressure drop across the fragmented mass at least in part due to processing layers in the fragmented mass as a function of the kerogen content of such layers;

establishing a processing zone in the fragmented mass;

introducing a processing gas at an inlet pressure to an upper portion of the fragmented mass for advancing the processing zone downwardly through the fragmented mass and for retorting oil shale therein;

withdrawing off gas at an outlet pressure from a lower portion of the fragmented mass monitoring outlet pressure of off gas withdrawn from the fragmented mass;

monitoring inlet pressure of processing gas introduced to the fragmented mass;

determining a pressure drop across the fragmented mass by subtracting such a monitored outlet pressure from a substantially simultaneously monitored inlet pressure; and comparing such a determined pressure drop with such a predicted pressure drop.

9. The method of claim 8 wherein the processing gas contains oxygen and the processing zone is a combustion zone.

10. The method of claim 8 wherein the comparing step comprises comparing the first derivative of such a determined pressure drop versus time with the first derivative of such predicted pressure drop versus time.

11. A method for determining the locus of a processing zone in a fragmented mass in an in situ oil shale retort in a subterranean formation containing oil shale, such an in situ oil shale retort containing a fragmented permeable mass of formation particles containing oil shale, the method comprising the steps of:

determining content of kerogen in such formation at a plurality of elevations in the fragmented mass;

introducing an inlet gas to an upper portion of the fragmented mass in the in situ oil shale retort;

withdrawing an off gas from a lower portion of the fragmented mass in the in situ oil shale retort;

predicting pressure differential between introduced inlet gas and withdrawn off gas as a function of inlet gas properties, inlet gas rate, and kerogen content of formation being processed at at least one elevation in the fragmented mass;

determining pressure differential between inlet gas introduced to the fragmented mass and off gas withdrawn from the fragmented mass; and comparing determined pressure differential with predicted pressure differential for at least one elevation in the fragmented mass.

12. The method of claim 11 wherein the inlet gas contains oxygen and the processing zone is a combustion zone.

13. The method of claim 11 wherein the processing zone is a retorting zone.

14. A method for determining if a processing zone advancing through a fragmented permeable mass of particles containing oil shale in an in situ oil shale retort in a subterranean formation containing oil shale is substantially planar and substantially normal to its direction of advancement through the fragmented mass, the retort having an inlet gas introduced thereto and an effluent gas passing therefrom, the oil shale containing kerogen, the method comprising the steps of:

determining content of kerogen in formation at selected locations in the retort before processing the selected locations;

predicting the first derivative of pressure drop across the fragmented mass versus time for processing such selected locations;

monitoring pressure drop across the fragmented mass;

determining the first derivative of monitored pressure drop across the fragmented mass; and comparing such a determined first derivative with such a predicted first derivative.

15. The method of claim 14 wherein the inlet gas contains oxygen and the processing zone is a combustion zone.

16. The method of claim 14 wherein the processing zone is a retorting zone.

17. A method for determining the locus of a processing zone advancing through a fragmented permeable mass of particles containing oil shale in an in situ oil shale retort in a subterranean formation containing oil shale, the retort having an inlet gas introduced thereto and an effluent gas withdrawn therefrom, the method comprising the steps of:

determining kerogen content in formation containing oil shale at selected locations in the retort before processing the selected locations;

predicting changes in the difference in pressure between the inlet gas and the effluent gas due to processing such selected locations;

determining change in the pressure difference between the inlet gas to the retort and the effluent gas from the retort during processing; and correlating such a determined change in pressure difference with such a predicted change in pressure difference.

18. The method of claim 17 wherein the processing zone is a retorting zone.

19. The method of claim 17 wherein the processing zone is a combustion zone.

20. The method of claim 17 wherein the step of determining comprises assaying formation which is outside the boundaries of the retort.

21. The method of claim 17 wherein the step of determining comprises assaying formation which is within the boundaries of the retort.

22. A method for determining the locus of a processing zone advancing through a fragmented mass in an in situ oil shale retort in a subterranean formation containing oil shale, such an in situ oil shale retort containing a fragmented permeable mass of formation particles containing oil shale, the method comprising the steps of:

determining content of kerogen in such formation at a plurality of elevations in the fragmented mass;

introducing an inlet gas to an upper portion of the fragmented mass in the in situ oil shale retort;

withdrawing an off gas from a lower portion of the fragmented mass in the in situ oil shale retort;

predicting changes in pressure differential between introduced inlet gas and withdrawn off gas as a function of inlet gas properties, inlet gas rate, and advancement of the processing zone through the fragmented mass;

determining changes in pressure differential between inlet gas introduced to the fragmented mass and off gas withdrawn from the fragmented mass; and comparing determined changes in pressure differential with predicted changes in pressure differential.

23. The method of claim 21 wherein the inlet gas contains oxygen and the processing zone is a combustion zone.

24. A method for determining the locus of a processing zone advancing through a fragmented permeable mass of particles containing oil shale in an in situ oil shale retort in a subterranean formation containing oil shale, the retort having an inlet gas introduced thereto and an effluent gas withdrawn therefrom, the method comprising the steps of:

determining kerogen content in formation containing oil shale at selected locations in the retort before processing the selected locations for predicting the pressure difference between the inlet gas and the effluent gas as a function of the advancement of the processing zone through the fragmented mass;

determining the pressure difference between the inlet gas to the retort and the effluent gas from the retort during processing; and correlating the determined pressure difference with such a predicted pressure difference.

25. The method of claim 24 wherein the processing zone is a retorting zone.

26. The method of claim 24 wherein the processing zone is a combustion zone.

27. The method of claim 24 wherein the steps of determining comprises assaying formation which is outside the boundaries of the retort.

28. The method of claim 24 wherein the step of determining comprises assaying formation which is within the boundaries of the retort.

29. A method for determining the locus of a processing zone advancing through a fragmented permeable mass of particles containing oil shale in an in situ oil shale retort in a subterranean formation containing oil shale, the subterranean formation including a plurality of generally horizontal strata having different kerogen contents, the retort having an inlet gas introduced thereto and an effluent gas withdrawn therefrom, the method comprising the steps of:

determining kerogen content in layers in the fragmented mass at selected elevations before processing the selected elevations;

determining a change in the pressure difference between the inlet gas to the retort and the effluent gas from the retort during processing; and correlating the determined change in pressure difference with a layer of determined kerogen content.

30. The method of claim 29 wherein the steps of determining comprises assaying formation which is outside the boundaries of the retort.

31. The method of claim 29 wherein the step of determining comprises assaying formation which is within the boundaries of the retort.

* * * * *

UNITED STATES PATENT AND TRADEMARK OFFICE

CERTIFICATE OF CORRECTION

PATENT NO. : 4,162,706

DATED : July 31, 1979

INVENTOR(S) : Chang Y. Cha

It is certified that error appears in the above-identified patent and that said Letters Patent are hereby corrected as shown below:

Column 4, line 21, "formation" should be -- fraction --. Column 8, line 55, "a" before "formation" should be deleted. Column 9, line 10, "Production" should be -- Prediction --. Column 11, line 10, -- was -- should be inserted after "start-up" and before "estimated".

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*